US008518197B2

(12) United States Patent
Diewald

(10) Patent No.: US 8,518,197 B2
(45) Date of Patent: Aug. 27, 2013

(54) INCENDIARY COMPOUND COMPRISING A COMBUSTIBLE FROM GROUP IVB OF THE PERIOD TABLE, AND PROJECTILE CONTAINING SAID INCENDIARY COMPOUND

(75) Inventor: Günther Diewald, Zürich (CH)

(73) Assignee: RWM Schweiz AG, Zürich (CH)

( * ) Notice: Subject to any disclaimer, the term of this patent is extended or adjusted under 35 U.S.C. 154(b) by 1119 days.

(21) Appl. No.: 12/085,014

(22) PCT Filed: Nov. 9, 2006

(86) PCT No.: PCT/EP2006/010709

§ 371 (c)(1),
(2), (4) Date: May 14, 2008

(87) PCT Pub. No.: WO2007/062732

PCT Pub. Date: Jun. 7, 2007

(65) Prior Publication Data

US 2009/0266261 A1 Oct. 29, 2009

(30) Foreign Application Priority Data

Nov. 29, 2005 (DE) ..... 10 2005 057 182

(51) Int. Cl.
*C06B 45/10* (2006.01)

(52) U.S. Cl.
USPC ..... 149/19.1

(58) Field of Classification Search
USPC ..... 149/19.1–19.91
See application file for complete search history.

(56) References Cited

U.S. PATENT DOCUMENTS

| | | | | |
|---|---|---|---|---|
| 3,809,586 | A | 5/1974 | Waite | |
| 4,131,498 | A | 12/1978 | Lucy | |
| 4,402,705 | A * | 9/1983 | Daume et al. | 149/19.91 |
| 5,707,419 | A | 1/1998 | Tsantrizos et al. | |
| 6,849,140 | B2 | 2/2005 | Thiesen et al. | |

FOREIGN PATENT DOCUMENTS

| | | |
|---|---|---|
| DE | 29 01 517 | 8/1979 |
| EP | 0 051 324 | 5/1982 |
| EP | 1 286 129 | 2/2003 |
| JP | 62124201 | 6/1987 |
| WO | WO 99/33596 | 7/1999 |
| WO | WO 01/81030 | 11/2001 |

* cited by examiner

*Primary Examiner* — Aileen B Felton
(74) *Attorney, Agent, or Firm* — Lucas & Mercanti, LLP; Klaus P. Stoffel

(57) ABSTRACT

Disclosed is an incendiary compound comprising spherical zirconium, titanium, or hafnium powder having an average grain size of 50 to 250 μm as well as a thermosetting or thermoplastic micronized organic binder which is added to the powder at a quantity of less than 1 percent by weight. The incendiary compound is fastened in the projectile or warhead by pressing and then thermally treating the same in order to activate crosslinking of the thermosetting binder or melt the thermoplastic binder.

12 Claims, No Drawings

INCENDIARY COMPOUND COMPRISING A COMBUSTIBLE FROM GROUP IVB OF THE PERIOD TABLE, AND PROJECTILE CONTAINING SAID INCENDIARY COMPOUND

This is a U.S. National Stage of application No. PCT/EP2006/010709, filed on Nov. 9, 2006. Priority is claimed on that application and on the following application:

Country: Germany, Application No.: 10 2005 057 182.4 Filed: Nov. 29, 2005

BACKGROUND OF THE INVENTION

The invention concerns an incendiary compound and a projectile.

Incendiary compounds are used as fragmentation incendiary rounds in a projectile body or warhead together with a high explosive and in armor-piercing projectiles that do not contain an explosive. The detonative or mechanical fragmentation of the projectile or warhead in or near the target causes the formation not only of fragments but also of high-speed particles of incendiary material that burn independently in the air. This results in an incendiary effect of long duration in a spatially large region.

Previously known fragmentation incendiary ammunition contains mixtures of high explosives, such as hexogen, octogen, TNT, and aluminum powder.

DE 29 01 517 describes an incendiary compound with an organic binder and a sponge metal, e.g., composed of zirconium or hafnium, where polytetrafluoroethylene is used as the binder in an amount of 2-15 wt. %.

EP 0 051 324 B1 of the present applicant discloses an incendiary compound of this general type, which contains an organic binder and metal particles. Proceeding from the prior art, in accordance with which the use of fluorinated binders promotes the formation of the tetrafluoride of the given metal, and in accordance with which metals in the form of coarse-grained, porous, spongy particles with a particle size of 0.05 to 8 mm are used with the goal of prolonging the burning time, the cited document proposes the use of metal powders with a mean particle size 15-50 μm. The binder, which is a halogen-free organic binder, namely, polyvinyl acetate, is present in an amount of less than 2 wt. %. Sufficient compressibility of the metal powder is thus still ensured. The metal additive itself produces an increase in the blast effect and a prolongation of the flame life from 1 ms to 15 ms. This increases the probability that combustible material will ignite.

EP 1 286 129 A1 discloses another incendiary compound for a fin-stabilized kinetic energy projectile, which has a good effect despite a relatively small volume and low weight. The incendiary charge is ignited by the shock waves generated by the impact of the projectile on the target. A sponge metal composed of titanium is used, and an epoxy resin or polyester resin is used as the binder. The particle size range of the titanium sponge metal is on the order of 450 μm, with 30% of the sponge metal having a particle size greater than 450 μm and 70% a particle size less than 450 μm.

SUMMARY OF THE INVENTION

The objective of the invention is to specify another incendiary compound that has a sufficiently long flame life.

This objective is achieved by an incendiary compound that consists of metallic fuel from group IVb of the Periodic Table of elements (Zr, Ti, Hf and an organic, halogen-free binder, in particular thermosetting plastics.

The invention is based on the empirically gained recognition that with a suitable grain-size distribution of the preferably spherical metal powder in the range of 50-250 μm, the amount of binder needed in the incendiary compound can be even less than 1 wt. %. The binder can thus be used in the least possible concentration that still guarantees sufficient compressibility and fixation of the incendiary compound. In addition, this distribution has shown the best results under practical conditions, especially in the use of explosive-free projectiles. The use of spherical metal powders, especially zirconium powder, with a large surface makes it possible for the binder to be applied dry on the surface of the metal powder, so that the flowability is increased and volumetric metering is possible. In this regard, volumetric means making the powder slippery by using coarse granules with submicron powder and at a predetermined temperature. Bakelit® is a good organic binder, which is used in micronized form and is thus conducive to volumetric metering.

It has been found that binders that contain halogen do not effectively support combustion of the metals. This can be derived from the volume-specific and mass-specific heat of reaction:

$$Zr+O_2 \rightarrow ZrO_2 - 12 \text{ kJ/g of metal}$$

(Reaction of the metal particles with atmospheric oxygen)

$$nZr+(C_2F_4)_n \rightarrow nZrF_4+2\ nC \text{ ca.} -6 \text{ kJ/g of mixture}$$

(Reaction of the metal particles with highly halogenated binders, e.g., polytetrafluoroethylene)

The metal fluorides formed in this way are highly volatile and extract energy from the system on evaporation. Therefore, as has already been mentioned, an organic binder, preferably one that does not contain halogen, is also incorporated in this incendiary compound. As noted earlier, this binder is preferably a micronized thermosetting or thermoplastic organic binder*.

The incendiary compound is worked into the projectile in an inert state; its function in the target is developed by means of chemical reaction with atmospheric oxygen (air-breathing system with thermobaric reaction as nonideal, high-blast explosives). The incendiary compound is fixed in the projectile or warhead by pressing and subsequent heat treatment to activate the thermosetting crosslinking or melting of the thermoplastic binder.

Other metal powders that can be used are titanium or hafnium. This type of metal powder is not produced from the reaction of the individual elements themselves but rather from starting materials that have been processed into rods. For example, the zirconium powder with the given mean particle size is not produced from zirconium itself but rather from a zirconium rod.

The result is that, especially in the case of low-caliber projectiles with an incendiary compound pressed in against targets with integrated fuel tanks, an excellent burning time of the incendiary compound was demonstrated. Furthermore, the distance traveled by the particles of incendiary compound released in the target and the reaction in the target space were tremendously improved.

Among other things, this can be attributed to the fact that the incendiary compound is activated only by the kinetic energy of the projectile carrying it and by air friction (spin), which is made possible by the mean grain size of the particles of metal powder. In this connection, the initiation and burn-off behavior of the incendiary compound can be controlled by variation of the grain size, i.e., by variation of the metal powder granulometry.

In principle, the new incendiary compound increases the flame life by a factor of 10 relative to the prior art.

The invention claimed is:

1. An incendiary compound, comprising metallic fuel selected from group IVb of the periodic table of elements (Zr, Ti, Hf); and a halogen-free organic binder, wherein the metallic fuel is a metal powder with a mean grain size of 50-250 μm, the halogen-free binder being present in an amount of less than 1 wt. %, wherein the halogen-free binder is applied dry on a surface of the metal powder.

2. The incendiary compound in accordance with claim 1, wherein initiation and burn-off behavior of the incendiary compound is controllable by variation of the metal powder granulometry.

3. The incendiary compound in accordance with claim 1, wherein the metal powder is present in spherical (atomized) form, and the binder is incorporated in micronized form.

4. The incendiary compound in accordance with claim 1, wherein the metal powder is produced from rods.

5. The incendiary compound in accordance with claim 1, wherein the binder is a micronized thermosetting plastic.

6. A projectile with a projectile body that contains no explosive and contains the incendiary compound in accordance with claim 1.

7. A projectile with a projectile body or warhead with explosive, and the incendiary compound according to claim 1 for fragmentation incendiary ammunition.

8. The projectile in accordance with claim 6, wherein the incendiary compound can be initiated only by kinetic energy of the projectile carrying it and by air friction.

9. The projectile in accordance with claim 7, wherein the incendiary compound can be initiated only by kinetic energy of the projectile carrying it and by air friction.

10. The projectile in accordance with claim 6, wherein the incendiary compound is worked into the projectile body in an inert state and develops functionality in a target by chemical reaction with atmospheric oxygen.

11. The projectile in accordance with claim 7, wherein the incendiary compound is worked into the projectile body in an inert state and develops functionality in a target by chemical reaction with atmospheric oxygen.

12. An incendiary compound, comprising:

hafnium as metallic fuel; and a halogen-free organic binder, wherein the metallic fuel is a metal powder with a mean grain size of 50-250 μm, the halogen-free binder being present in an amount of less than 1 wt. %, wherein the halogen-free binder is applied dry on a surface of the metal powder.

* * * * *